US008585826B2

(12) United States Patent
Schreiber et al.

(10) Patent No.: US 8,585,826 B2
(45) Date of Patent: Nov. 19, 2013

(54) APPARATUS AND METHOD FOR CLEANING FLEXIBLE WEBS

(75) Inventors: Brian E. Schreiber, Oakdale, MN (US); William B. Kolb, West Lakeland, MN (US); Keith R. Bruesewitz, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 225 days.

(21) Appl. No.: 13/130,183

(22) PCT Filed: Nov. 16, 2009

(86) PCT No.: PCT/US2009/064499

§ 371 (c)(1),
(2), (4) Date: May 19, 2011

(87) PCT Pub. No.: WO2010/065270

PCT Pub. Date: Jun. 10, 2010

(65) Prior Publication Data

US 2011/0220147 A1 Sep. 15, 2011

Related U.S. Application Data

(60) Provisional application No. 61/117,756, filed on Nov. 25, 2008.

(51) Int. Cl.

| | |
|---|---|
| ***B08B 1/02*** | (2006.01) |
| ***B08B 3/00*** | (2006.01) |
| ***B08B 5/00*** | (2006.01) |

(52) U.S. Cl.

USPC ..... 134/15; 134/6; 134/26; 134/30; 134/32; 134/34; 134/37; 15/3; 15/77; 15/88.2; 15/88.3; 15/102; 15/256.5; 15/300.1; 15/302; 15/303; 15/306.1; 15/308; 15/309.1

(58) Field of Classification Search
None
See application file for complete search history.

(56) References Cited

U.S. PATENT DOCUMENTS

| | | | |
|---|---|---|---|
| 2,967,119 | A | 1/1961 | Gutterman |
| 3,615,814 | A | 10/1971 | Ott |

(Continued)

FOREIGN PATENT DOCUMENTS

| | | |
|---|---|---|
| DE | 10 2005 008 939 | 9/2006 |
| EP | 0 481 757 | 4/1992 |

(Continued)

OTHER PUBLICATIONS

Cooper, D.W., et al., "Comparing the Effectiveness of Knobby and Ridged Post-CMP Cleaning Brushes", Micro (Jul./Aug. 1999), pp. 1-9.

(Continued)

*Primary Examiner* — Nicole Blan
(74) *Attorney, Agent, or Firm* — Scott A. Baum; Adrian L. Pishko

(57) ABSTRACT

A method of web cleaning, particularly relatively soft polymeric webs, without using dipping baths or ultrasonic energy. The method includes conveying the web against a backup roller and spraying the web with a high pressure liquid while the web is supported by the backup roller. Thereafter, residual fluid from the high pressure stream is stripped from the web by a gas curtain while the web is supported by the backup roller. In many convenient embodiments, the web is contacted with a cleaning roller while the web is in contact with the backup roller.

16 Claims, 3 Drawing Sheets

(56) References Cited

U.S. PATENT DOCUMENTS

| | | | | |
|---|---|---|---|---|
| 3,635,762 | A | 1/1972 | Ott | |
| 3,654,654 | A | 4/1972 | Abreu | |
| 3,737,941 | A | 6/1973 | Miller | |
| 3,958,292 | A | 5/1976 | Powell | |
| 4,138,757 | A | 2/1979 | Henderson | |
| 4,244,078 | A | 1/1981 | Hughes | |
| 4,341,687 | A | 7/1982 | Ozeki | |
| 4,364,147 | A | 12/1982 | Biedermann | |
| 4,594,748 | A | 6/1986 | Warfvinge | |
| 4,783,947 | A | 11/1988 | Posey | |
| 4,788,992 | A | 12/1988 | Swainbank | |
| 4,924,891 | A | 5/1990 | Soubrier | |
| 5,337,767 | A | 8/1994 | Ernst | |
| 5,447,170 | A | 9/1995 | Stein | |
| 5,505,787 | A | 4/1996 | Yamaguchi | |
| 5,554,659 | A * | 9/1996 | Rosenblatt | 521/51 |
| 5,556,479 | A | 9/1996 | Bran | |
| 5,596,783 | A | 1/1997 | Tetone | |
| 5,598,262 | A | 1/1997 | Jutard | |
| 5,681,399 | A | 10/1997 | Okano | |
| 5,753,563 | A | 5/1998 | Guan | |
| 5,779,811 | A | 7/1998 | Machii | |
| 5,802,648 | A | 9/1998 | Neun | |
| 5,902,678 | A | 5/1999 | Konda | |
| 5,975,098 | A | 11/1999 | Yoshitani | |
| 5,991,954 | A | 11/1999 | Kubota | |
| 6,086,798 | A | 7/2000 | Hirukawa | |
| 6,092,399 | A | 7/2000 | Tung | |
| 6,123,777 | A | 9/2000 | Sakurai | |
| 6,148,831 | A | 11/2000 | Lindstrom | |
| 6,176,245 | B1 | 1/2001 | Takahashi | |
| 6,231,679 | B1 | 5/2001 | Mandai | |
| 6,266,836 | B1 | 7/2001 | Gallego Juarez | |
| 6,401,287 | B1 | 6/2002 | Corrado et al. | |
| 6,503,332 | B1 | 1/2003 | Kawanishi | |
| 6,507,393 | B2 | 1/2003 | Batchelder | |
| 6,598,255 | B1 | 7/2003 | Gohda | |
| 6,598,261 | B2 | 7/2003 | Howard | |
| 6,659,849 | B1 | 12/2003 | Li | |
| 6,675,423 | B2 | 1/2004 | Egan | |
| 6,735,812 | B2 * | 5/2004 | Hekman et al. | 15/320 |
| 6,776,171 | B2 | 8/2004 | Carpenter | |
| 6,905,573 | B2 | 6/2005 | Maenpaa | |
| 6,910,487 | B2 | 6/2005 | Mertens | |
| 7,030,400 | B2 | 4/2006 | Rivera | |
| 7,032,324 | B2 | 4/2006 | Kolb | |
| 2002/0108202 | A1 * | 8/2002 | Leisinger et al. | 15/302 |
| 2003/0046787 | A1 | 3/2003 | Howard | |
| 2004/0009354 | A1 | 1/2004 | Krepski | |
| 2004/0241454 | A1 | 12/2004 | Shaw | |
| 2005/0204580 | A1 | 9/2005 | Jewitt | |
| 2005/0205117 | A1 | 9/2005 | Mandai | |
| 2005/0238871 | A1 | 10/2005 | Robinson | |
| 2006/0042654 | A1 | 3/2006 | Takemura | |
| 2006/0044993 | A1 | 3/2006 | Hongo | |
| 2006/0060213 | A1 | 3/2006 | Huber | |
| 2006/0086272 | A1 | 4/2006 | Bennet | |
| 2006/0116057 | A1 | 6/2006 | Moore | |
| 2007/0084576 | A1 * | 4/2007 | Hermans et al. | 162/199 |

FOREIGN PATENT DOCUMENTS

| | | | | |
|---|---|---|---|---|
| EP | 0481757 | A1 * | 4/1992 | D06B 5/08 |
| EP | 0 647 882 | A1 | 4/1995 | |
| EP | 0 993 023 | A1 | 4/2000 | |
| EP | 1 484 805 | A2 | 12/2004 | |
| GB | 1 430 231 | | 3/1976 | |
| JP | 61-132670 | | 6/1986 | |
| JP | 62-263370 | | 11/1987 | |
| JP | 05-279951 | | 10/1993 | |
| JP | 11-216824 | | 8/1999 | |
| JP | 2003-112134 | | 4/2003 | |
| JP | 2003-300025 | | 10/2003 | |
| JP | 2005-522586 | | 7/2005 | |
| WO | WO 01/54836 | | 8/2001 | |
| WO | WO 03/087437 | | 10/2003 | |
| WO | WO 2006/089730 | | 8/2006 | |

OTHER PUBLICATIONS

ITW TexWipe Datasheet, "TX5377 HydroCell® Nodule Brush", *ITW Texwipe®* (May 2007).

Occhiello, E., et al., "On the Application of XPS, SSIMS and QCM to Study the Surface of a $CF_4/O_2$ Plasma Treated Polycarbonate", *Applied Surface Science*, vol. 36, (1989), pp. 285-295.

Supplementary European Search Report, EP Application No. 09830832, mailed Mar. 7, 2013.

* cited by examiner

APPARATUS AND METHOD FOR CLEANING FLEXIBLE WEBS

TECHNICAL FIELD

The present invention is related to the production of ultra-clean surfaces and more particularly for a method of cleaning flexible webs.

BACKGROUND

It is known that in modern industry there are some production processes, e.g. the manufacture of silicon wafers for microprocessors, where the tiniest speck of debris may be damaging. Certain techniques are known for the removal of even ultra-fine particles from such hard surfaces. However, more recently with increased industry movement to lighter, thinner devices both optical and electronic, the requirement for ultra-clean materials has spread to high-volume roll-to-roll production using webs of materials. While webs of hard materials, e.g. stainless steel, have been seen in this expanding market, more often polymeric materials are desired for their flexibility and optical transparency. In the same way that tiny debris can be damaging to silicon wafers, tiny debris can be a significant problem in the roll-to-roll processing of webs with the additional complications of their being many times the area needing to be cleaned, and usually, the presence of much softer surfaces. Still, webs of hard and opaque materials can benefit from cleaning of small particles from the surface.

SUMMARY

The present invention provides a method of cleaning a web of material, particularly relatively soft polymeric webs, without using dipping baths or ultrasonic energy. In one aspect, the method includes: supporting the web with a backup roller; spraying a first surface of the web with a high pressure liquid while a second opposing surface of the web is in contact with the backup roller; and directing a gas curtain at the first surface, after spraying, while the opposing second surface is supported by the backup roller. A number of fluids are considered suitable for the spraying, but ultra pure water, deionized water, water containing a surface-active agent, organic solvents, and high specific gravity fluids, are considered particularly convenient depending on the type of web to be cleaned. It is particularly convenient to pre-filter the fluid being used in connection with the present invention.

In another embodiment, the web of material is contacted with a cleaning roll while the web is in contact with the backup roller. A cleaning roll having a porous, knobby surface has been found useful, and is conveniently made from polyvinyl alcohol (PVA) or its variants. The knobby roll can have cylindrical mesas or other patterned mesas. It is typical for the cleaning roll to be fed internally with fluid transferred radially out through the pores as it rubs against the web in a direction opposite to the web's direction of movement. The knobby roller is compressed typically from 0.5 to about 2.5 mm measured radially as it is nipped against the web and backup roller. The method may optionally include wetting the web material prior to contacting it with the cleaning roll. This method may optionally include utilizing wetting agents or surfactants in the flow of the fluid through the knobby roller or as a dripped concentrate over the rotating surface of the roller.

In another embodiment, it is useful to perform parts or all of the method while retaining the web of material in a clean room having a particle-controlled atmosphere while cleaning the web. The web of material can be located in a clean room meeting the limits of Federal Standard 209 "Airborne Particulate Cleanliness Classes in Cleanrooms and Clean Zones." In particular, the clean room can meet the conditions for Class 10,000, or Class 1,000, or Class 100, or Class 10 under Federal Standard 209.

In another aspect, the apparatus for cleaning a web of material includes: a backup roller positioned to wrap the web at least partially about the backup roll; a source of high pressure liquid connected to at least one nozzle for spraying the web while the web is supported by the backup roll; and a source of gas connected to an exit gas curtain located after the at least one nozzle, the gas curtain orientated crosswise to the direction of the web's travel and positioned for removing liquid from the web while the web is supported by the backup roll.

DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary construction.

Figure 1:
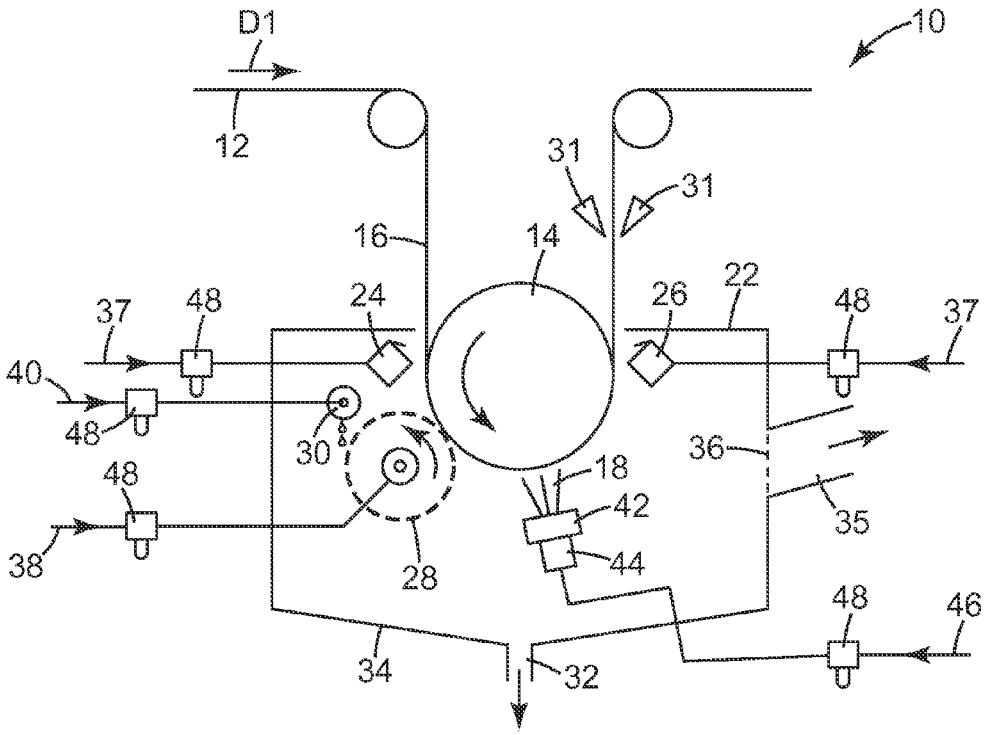
FIG. 1 illustrates a side view of a web cleaning apparatus according to the present invention.

Repeated use of reference characters in the specification and drawings (not drawn to scale) is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "high pressure" is defined as about 500 psi (3.45 MPascal) to about 3000 psi (20.68 MPascal) with about 1000 psi (6.89 MPascal) to about 2500 psi (17.24 MPascal) being considered particularly convenient.

DETAILED DESCRIPTION

Referring now to FIG. 1, a first embodiment of a web cleaning apparatus 10 according to the present invention is illustrated acting on a web 12 moving in direction D1. The flexible web 12 typically has a length significantly greater than its width. The flexible web's length can be indefinite for a polymeric web that is continuously formed and then cleaned, or it can be a predetermined length for previously formed flexible webs that are wound into a roll and then unwound for web cleaning. In various embodiments of the invention, the length of flexible web 12 can be greater than 10 feet (3.0 meters), or greater than 100 feet (30.4 meters), or greater than 1,000 feet (304.8 meters).

The flexible web 12 is supported by a backup roll 14, which may be a driven or non-driven roll. The flexible web can be tangent to the backup roll (0 degrees wrap) or the flexible web can wrap a significant portion of the circumference of the backup roll for the necessary support. Suitable flexible web wraps can be between 0 degrees to about 270 degrees, or between 10 degrees to about 180 degrees. Particularly suitable wrap angles include 0 degrees, 90 degrees, or 225 degrees. Larger wrap angles can allow for multiple spray nozzles, multiple cleaning rolls, gas deflectors and other apparatus to be located about the periphery of the backup roll. While being supported by the backup roll, a first side 16 of the flexible web 12 is subjected to a high pressure liquid spray 18 to clean the first surface.

By stabilizing the flexible web on the backup roll 14, several advantages occur when contacting the flexible web with the high pressure liquid spray. First, a precise high pressure spray can be employed since the flexible web is prevented from moving or displacing in response to the high pressure spray. The angle of the high pressure spray relative to the flexible web's surface can be precisely set and maintained. The distance between a spray nozzle 42 and the flexible web's surface can be precisely set and maintained. These process variables can be adjusted based on the spray pressure and the type of flexible web being cleaned. Secondly, less damage to the flexible web 12 can result. If an unsupported flexible web 12 was subjected to a high pressure spray 18, the liquid impact can reposition, move or displace the web and is likely to cause web flutter. The web flutter can lead to web wrinkling and/or damage of the web's surface and inconsistent cleaning of the web's surface. For wide flexible webs, any cross-direction (CD) non-uniformity of the high pressure spray can cause twisting or fluttering of an unsupported span leading to non-uniform cleaning and severe web handling problems. Finally, an unsupported flexible web can require a greater machine direction (MD) tension to resist the spray's impact. A higher MD tension can permanently distort the flexible web, which is undesirable for some applications.

In general, the backup roll 14 can have a smooth, uniform surface to prevent damaging a second side 20 of the flexible web in contact with the backup roll. Additionally, it can have conductive properties to assist in controlling static charge generated by the flexible web leaving the roll. Suitable backup rolls can include metal rolls such as aluminum or steel, deformable rolls, rubber rolls, compressive cover rolls, graphite or non-conductive rolls, rolls having durable hard coatings, anodized rolls, rolls with conductive coatings, or other suitable web processing rolls.

The choice of backup roll material can be influenced by the selection of the high pressure fluid used in order to prevent corrosion issues. The backup roll should not be susceptible to shedding particles or coatings onto the second side 20. The backup roll diameter can be determined based on deflection considerations and space considerations when designing the web cleaning apparatus Additional equipment included in the web cleaning apparatus 10 include, a spray chamber 22, an optional entry gas curtain 24, an exit gas curtain 26, an optional cleaning roller 28, an optional drip bar 30, and optional static neutralizers 31. The spray chamber 22 is mostly enclosed and may closely conform to at least a portion of the backup roll's circumference. Suitable materials for constructing the spray chamber 22 include plastic and metal materials known to those of skill in the art. At the entrance and exit of the spray chamber 22, the gaps between the spray chamber and the backup roll 14 are minimized to allow the flexible web 12 sufficient clearances to enter and exit the spray chamber without hitting the spray chamber. Alternatively, retractable flaps or doors, air knifes, and/or rollers can be provided that open for threading or splices and then close during normal operation. The spray chamber's CD width can closely conform to maximum CD width of the flexible web and the spray chamber's CD ends can closely conform to the backup roll's diameter. If desired, end seals can be used to seal the spray chamber's CD ends to the surface of the backup roll.

The spray chamber 22 includes a drain 32 and a bottom 34 of the spray chamber can be sloped to move liquid towards the drain. In some embodiments, the liquid is filtered and cleaned for additional use. The spray chamber 22 also includes at least one exhaust duct 35. The exhaust duct 35 can be fitted with a demisting mesh 36 to reduce mist intake into the exhaust duct. Alternatively or in combination, a mist separator or aerosol filter can be used to remove the liquid from the exhaust gas. In one embodiment, the exhaust duct 35 sloped upwardly away from the spray chamber to drain liquid into the spray chamber. In another embodiment, the exhaust duct 35 is operated to induce a negative gas pressure in the spray chamber 22 or to reduce the gas pressure inside the spray chamber resulting from the high pressure spray and gas curtains. A low or negative spray chamber air pressure minimizes or eliminates mist from exiting the spray chamber and can be set to minimize the draw of ambient air into the spray chamber 22 at any open draft areas between the spray chamber, the backup roll 14, and the web 12. Suitable air pressures inside the spray chamber can be between about between about −0.001 inches of water gage to about −0.50 inches of water gage, or between about −0.001 inches of water to about −0.1 inches of water gage. In some embodiments, −0.032 inches of water gage and −0.05 inches of water gage are used.

The optional entry gas curtain 24 and the exit gas curtain 26 can be used to further contain any mist within the spray chamber. The gas curtains may be located either inside or outside of the spray chamber. Suitable gas curtains can include air knifes, air bars, or air nozzles that can provide a substantially homogenous line of gas across the CD width of the flexible web or spray chamber. In one embodiment, air knifes such as the Standard Air Knife or the Super Air Knife manufactured by Exair Corporation located in Cincinnati, Ohio have been used successfully. In another embodiment, regenerative blowers and sheet metal nozzles can be used to provide the entry and exit gas curtains.

The CD uniformity of the entry gas curtain 24 is less critical since its main function is to prevent liquid and mist from exiting the spray chamber 22. With sufficient exhaust air flow or for an apparatus located where misting is less of a concern, the entry gas curtain 24 can be eliminated.

The exit gas curtain 26 is used to strip away the majority of any liquid film adhering to the first surface 16 of the flexible web 12 and then assist in drying any remaining liquid film by evaporation. Desirably, the liquid film is uniformly removed to prevent streaking, water spotting, or leaving excess moisture that may attract or concentrate dirt particles. The backup roll 14 assists the exit gas curtain 26 by stabilizing the flexible web 12 allowing for the precise placement and orientation of the exit gas curtain. In one embodiment, an Exair model 2012SS air knife is located such that the highest pressure line of the air curtain is located approximately 0.010 inch (0.254 mm) to about 0.030 inch (0.635 mm) from the first surface 16 of the flexible web 12 while the web is supported by the backup roll 14. The gas curtain impinges the first surface 16 at an angle between 0 degrees to about 90 degrees, or between 70 degrees to about 90 degrees relative to the web's surface. In one embodiment, an angle of approximately 80 degrees was used. In general, the entry and exit gas curtains are adjusted such that the majority of the gas supplied by the gas curtain traverses in a direction opposite to the direction of the web's travel.

A source of gas 37 that is fed to optional entry gas curtain 24 and the exit gas curtain 26 can be filtered by an oil coalescing filter 48 and dewatered using filtration equipment known to those of skill in the art. In some embodiments, the gas is compressed to a pressure between about 5 psi and about 100 psi to increase the flow from the gas curtains. Useful gases can include air, nitrogen, or other suitable gases. In particular, the supplied gas should be clean and substantially free of moisture or other liquid contaminants. In one embodiment, compressed air is filtered of all particles having a size greater than 0.01 micron absolute and then supplied to the air curtains. In one embodiment, the gas 37 supplied to the exit gas curtain 26 is heated to assist with evaporative drying of any remaining moisture on the web. The gas 37 being fed to the exit gas curtain 26 can have a temperature between about 60 degrees F. (15.5 degrees C.) and about 500 degrees F. (260 degrees C.). The temperature of the compressed gas can be determined based on the sensitivity of the flexible web material to heat and the dwell time during which the flexible web material is subjected to the gas curtain. Additional drying equipment such as infrared radiation, microwave, convection, or conduction drying can be used to evaporate any remaining moisture if needed. Additional drying equipment such as PVA sponge rollers can be used to first remove most of the moisture before air knives or other remedial measures are employed downstream.

To further assist with cleaning the first surface 16, the first surface can be run though a nip between an optional cleaning roller 28 and the backup roll 14. Suitable cleaning rollers 28 can include brush rolls and sponge covered rolls. The surface of the cleaning roller 28 can be bristle, ribbed, textured, dimpled, or knobby. Desirably, the cleaning roller 28 is made of a porous material such that a first cleaning fluid 38 can be supplied to the interior of the cleaning roller for application to the first surface 16. The first cleaning fluid 38 can be the same liquid supplied to the high pressure spray 18 or different depending on the flexible web material being cleaned. Suitable cleaning fluids include de-ionized water, ultra pure water, or filtered water with surface acting agents. Typically, ammonium hydroxide in a ratio of approximately 0.10 to 2% concentration by weight is included in the fluid to assist in particle neutralization for ease of removal. Desirably, the cleaning roller 28 is readily deformable such that it can yield and conform to the first surface 16 as it rubs against that surface. In one embodiment, the surface of the cleaning roller 28 is compressed between about 0.5 mm (0.02 inch) to about 2.5 mm (0.1 inch) when in contact with the first surface.

To further enhance cleaning of the first surface 16, the cleaning roller 28 can be run at a surface velocity differential to the surface velocity of the first surface. The velocity differential can be in the same direction at a different surface speed, in an opposing direction at the same surface speed, or in an opposing direction at a different surface speed as the first surface 16. In one embodiment, the cleaning roller is rotated in an opposing direction to the rotation of the backup roller 14 and at a surface speed faster than the speed of the first surface 16. Suitable surface speed differentials can be between about plus 1000% and minus 1000%.

In one embodiment, a knobby cleaning roller is used having a plurality of small protrusions or mesas on its outer surface that readily compress. The knobby protrusions not only assist with cleaning the first surface, but reduce drag of a counter rotating, compressed knobby cleaning roller. A particularly suitable cleaning roller 28 is a TEXWIPE model TX 5580 nodule cleaning brush, commercially available from ITW Texwipe of Mahwah, N.J. This cleaning roller has an apparent density of approximately 0.12 g/cm$^3$, an effective porosity of 89%, an equivalent pore diameter of 528 um, and a 30% compressive strength of 71.5 g/cm$^2$. Typical knobby rollers are available that are made from polyvinyl acetal (PVA) or polyvinyl alcohol (PVA) or polyvinyl-formal (PVF).

To further assist in cleaning the first surface, the drip bar 30 can apply a surfactant solution 40 to the periphery of the cleaning roller 28 or to the first surface 16 of the flexible web 12. Suitable surfactant solutions include ammonium hydroxide ($NH_4OH$) and other cationic, anionic, or non-ionic surfactants. In one embodiment, a 0.1% solution of ammonia hydroxide is supplied at a flow rate of approx 30 ml/min to a drip bar having a plurality of 0.03 inch (0.76 mm) diameter holes spaced at 1 inch (2.54 mm) along the length of the tube with the bar positioned to drip onto the surface of the cleaning roller 28. Ammonium hydroxide can assist with cleaning the first surface 16 by equalizing the zeta potential between the dirt particles and the first surface. This reduces the attraction and allows them to be more easily removed via mechanical disturbance.

Figure 2:
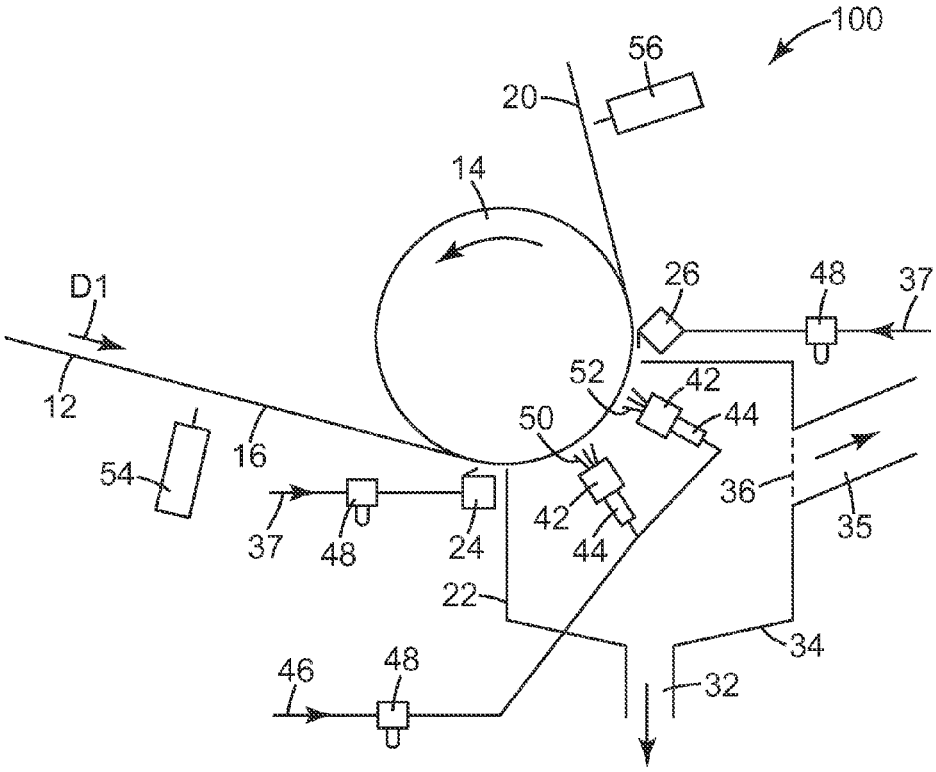
FIG. 2 illustrates a side view of another embodiment of a web cleaning apparatus according to the present invention.
Figure 3:
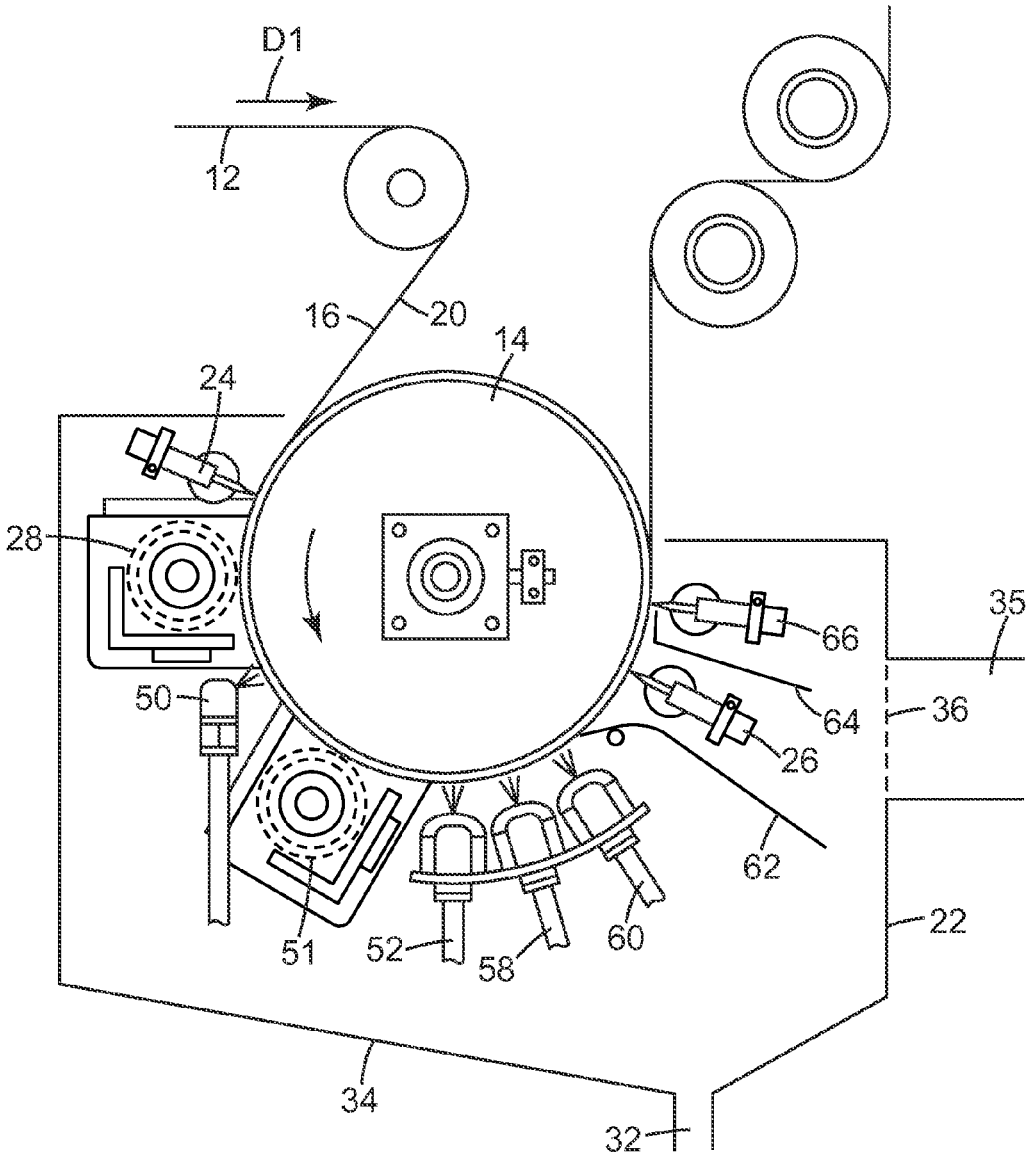
FIG. 3 illustrates a side view of another embodiment of a web cleaning apparatus according to the present invention.

After the optional cleaning roller 28, the first surface 16 is subjected to the high pressure spray 18. The high pressure spray 18 is provided by one or more spray nozzles 42 attached to a CD spray manifold 44 that direct the high pressure spray 18 onto the first surface 16. The web cleaning apparatus can include multiple CD spray manifolds located about the periphery of the backup roll thereby creating more than one high pressure spray zone as shown in FIGS. 2 and 3. Suitable spray nozzles can include nozzles designed for fan spray patterns to concentrate spray forces into a line across the surface. One suitable nozzle is Spraying Systems Co., Wheaton, Ill., model number TPU150017. In general, the orifice of the spray nozzles can be between about 0.011 inch (0.279 mm) to about 0.015 inch (0.381 mm) equivalent diameter and the spray fan can be between about 5 degrees to about 20 degrees. The spray from the spray nozzles is directed to impinge the first surface 16 at an angle from about 45 degrees to about 90 degrees, such as from about 70 degrees to about 90 degrees relative to the web's surface.

When more than one spray nozzle is attached to the CD spray manifold 44, each individual spray nozzle can be rotated relative to the CD direction such that the spray fan is between an angle of about 1 degree to about 10 degrees relative to the CD direction. Rotation of the spray nozzles can prevent the impingement of adjacent spray fans with each other and provides a more uniform spray across the entire first surface 16. Spray nozzles are spaced along the spray manifold to ensure that the first surface is uniformly subjected to the high pressure spray without missing any areas and while allowing slight overlap between adjacent spray nozzles. Suitable deflectors or valves can be used to selective clean the web's surface or to run narrower web's though the web cleaning apparatus.

A source of high pressure liquid 46 is provided to the spray manifold 44. Suitable liquids for the high pressure spray 18 include ultra pure water, de-ionized water, and water containing a surface-active agent, organic solvents, and high specific gravity fluids. High specific gravity fluids can include HFE (hydrogen fluorinated ethers) or similar high specific gravity low surface tension fluids. An absolute filter 48 is provided to remove most particles exceeding approximately 0.2 microns diameter and larger from the liquid before it is applied to the first surface.

In one embodiment, water was supplied by filtering the water to remove particles exceeding approximately 0.2 microns, de-ionizing, and then re-ionizing the water. In another embodiment, the water is filtered and de-ionized. Re-ionization is preferentially performed by passing de-ionized water across a membrane with carbon dioxide ($CO_2$) on the opposite side. The $CO_2$ is transferred across the membrane into the water. As a result of the process of purifying water, de-ionized water possesses a polar character that causes it to naturally disassociate into an ionic state of a low concentration of oxonium $H_3O^+$ and hydroxyl ions —OH. Metals in contact with highly de-ionized water can show localized ionization and actual structural damage at the surface. The ferrous metals can then shed ions to be deposited as impurities on the web being cleaned. Additionally, high velocity sprays of de-ionized water can generate a corona and subsequent high static charge. Such charges imparted to dielectric polymer webs are detrimental in that static charges can cause particles to be highly attracted to the web. However, in the reaction that results from mixing de-ionized water and $CO_2$, the water acquires new ions that effectively neutralize its ionic character. Thus, re-ionization can prevent ionic damage to metals in the pressurized piping system and minimize static buildup on the web. Also, using $CO_2$ restores neutral ions without adding ions that could be a source of impurities.

The apparatus in FIG. 1 is shown with a single backup roll for supporting the flexible web 12 while being subjected to the gas curtains, cleaning roller, and high pressure spray. However, it is possible to use more than one backup roll 14 within the spray chamber 22 to support the web as it is processed. For example, a first backup roll can be used in conjunction with the entry gas curtain 24 and the knobby roller 28; a second backup roller can be used in conjunction with the high pressure spray 18; and a third backup roll used in conjunction with the exit gas curtain 26. One or more backup rolls can be used to support the web during each process operation.

Referring now to FIG. 2, a second embodiment of the web cleaning apparatus 100 is shown. The apparatus includes a spray chamber 22, an optional entry gas curtain 24, two spray manifolds 44 each having a plurality of spray nozzles 42 thereby creating a first high pressure spray zone 50 and a second high pressure spray zone 52 along the periphery of the backup roll 14, an exit gas curtain 26, a first inspection system 54, and a second inspection system 56. The inspection system can include a camera and lighting to detect debris on the surface of the web.

In the web cleaning apparatus of FIG. 2, the flexible web 12 wrapped the backup roll 14 approximately 100 degrees. The gas curtains (24, 26) were located outside of the spray chamber 22 as shown. Locating the air curtains outside the spray chamber, can further enhance containment of mist within the spray chamber. In other embodiments, the air curtains can be located inside the spray chamber as shown.

Using the inspection systems (54, 56), it is possible to measure the number of particulates on the first surface 16 prior to being subjected to the high pressure spray and then measure the number of particulates on the first surface after cleaning. The inspection systems are mounted in a fixed CD position to insure the same CD position of the flexible web is inspected by both the first and the second inspection systems (54, 56).

Referring now to FIG. 3, a third embodiment of the web cleaning apparatus 150 is shown. The web cleaning apparatus includes in the direction, D1, of web travel around the backup roll 14: an optional entry gas curtain 24, a first cleaning roller 28, a first high pressure spray 50, a second cleaning roller 51, a second, a third, and a fourth high pressure spray (52, 58, 60), a first air deflector 62, a first exit gas curtain 26, a second air deflector 64, and a second exit gas curtain 66. The web cleaning components are housed in a spray chamber 22. For clarity, liquid and gas connections to the individual components have been eliminated.

The individual components operate in the same manner as described for the web cleaning apparatus 10 of FIG. 1. The optional entry and exit gas curtains are mounted on adjustable carriages, which allow for the orientation of the gas curtain (distance to the web and impingement angle) to be adjusted. Similarly, the cleaning rollers are mounted on adjustable carriages, which allow for the degree of compression of the cleaning roller to be adjusted. The cleaning rollers are all driven, with the rotation of the cleaning rollers reversed, relative to the direction of the web 12 to increase the velocity differential.

The first and the second air deflectors (62, 64) are designed to scoop and deflect the mix of air and liquid particles (aerosol spray). As such, the leading edge of each air deflector is closely positioned just above the first surface 16. The first air deflector 62 is designed to divert the aerosol mist away from the exit of the spray chamber. It can be porous with holes allowing some transfer of the aerosol to the demister 36. The second air deflector 64 is designed to channel any remaining aerosol and flow from the exit gas curtain 26 towards the exhaust duct 35. Removal of any residual liquid droplets at the second exit gas curtain 66 assists in mist containment and drying of the first surface.

Figure 4:
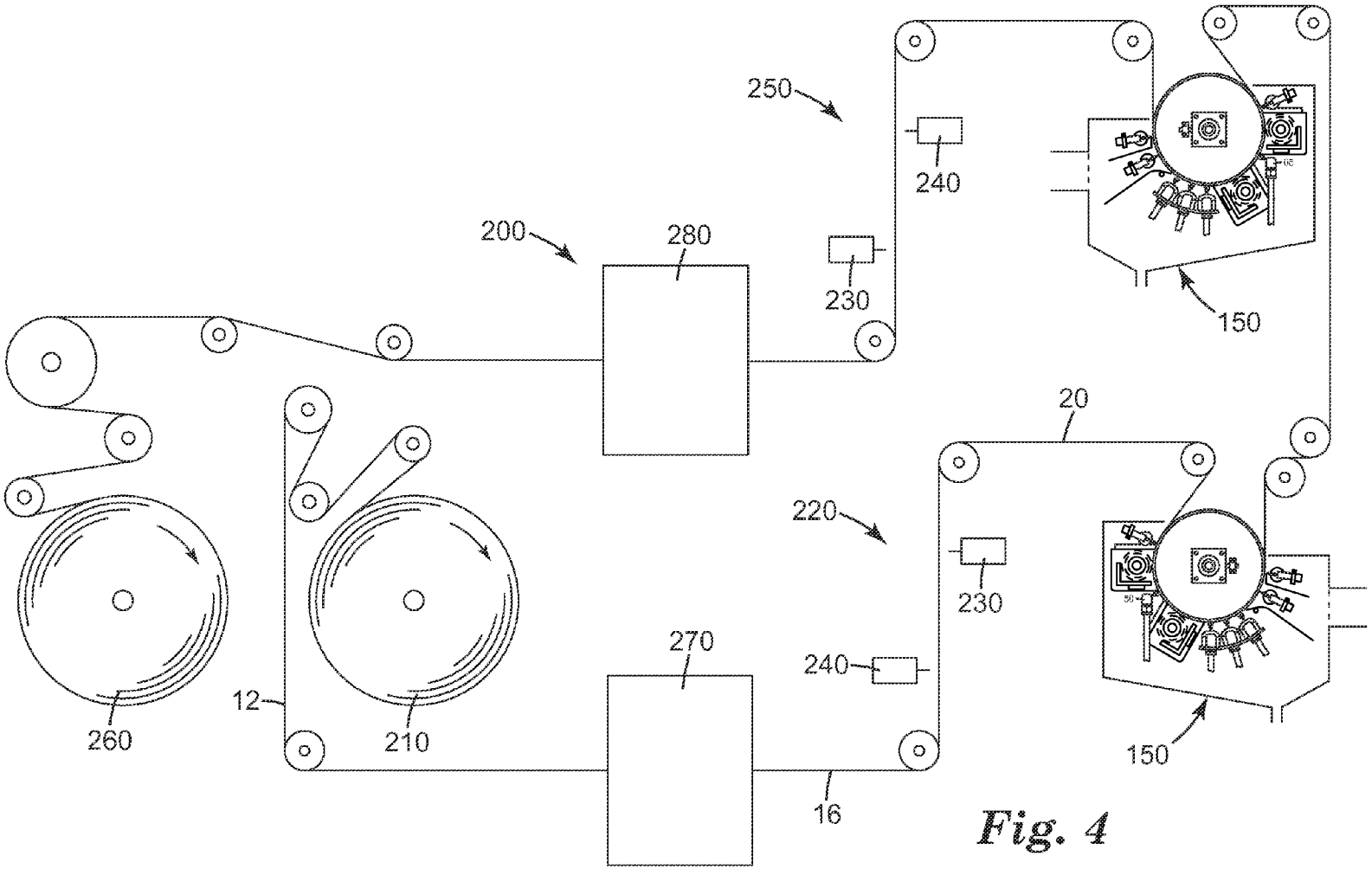
FIG. 4 illustrates a side view of a web cleaning line.

Referring to FIG. 4, a web cleaning line 200 is shown. The web cleaning line can be located in a clean room environment to prevent contaminating the web with particles after cleaning. The web cleaning line 200 includes an unwind 210 for feeding the flexible web 12 to a first inspection station 220 having a first inspection system 230 focused on the first side 16 of the flexible web and a second inspection system 240 focused on the second side 20 of the web. To measure the surface contaminant particles high intensity light can be amplified to a level that is reflected by small particles or surface discontinuities. The reflected light can then be measured by sensitive elements located in the reflected light path. In this manner, individual dirt particles can be isolated and counted electronically as they pass through the inspection point.

After the first inspection station 220, the first side 16 of the flexible web 12 is cleaned with the web cleaning apparatus 150 of FIG. 3. The second side 20 of the flexible web is then cleaned with another web cleaning apparatus 150. A second inspection station 250 having a first inspection system 230 focused on the first side 16 and a second inspection system 240 focused on the second side 20 is located after the second web cleaning apparatus. The flexible web then passes to a winder 260 for winding into a roll.

Additional web processing equipment can be located either before or after each of the web cleaning apparatus. For example, a slitting section 270 could be located before the web cleaning apparatus and the equipment then used to remove small particles created by the slitting. Alternatively, a coating section 280 could be located after the web cleaning apparatus. In general, where contaminant free, flexible web surfaces are needed, the web cleaning apparatus can be employed to clean one or both sides of the flexible web.

The web cleaning line also includes tension sensing rollers, pull rolls, and idler rollers as known to those of skill in the art to transport the flexible web through the line while maintaining control of the web. Additionally, depending on the web material being cleaned, static control equipment such as active or passive static elimination bars and grounding conductors can be deployed at various points throughout the web cleaning line to neutralize any static build up by the flexible web.

After being subjected to the cleaning operation of FIG. 1, 2, or 3, the first surface and/or the second surface of the web is substantially free of extremely small dirt and debris. In particular, more than about 90%, or more than about 95%, or more than about 97% of small dirt and debris particles having a particle size of 3 microns or greater can be removed from the surface of the web being cleaned.

The effectiveness of this wet web cleaning apparatus has been compared to dry web cleaning systems and found far superior. For example, nipped contact cleaning roll (CCR) systems and high velocity air knives with vacuum bar particle removal nozzles have been shown using highly sophisticated automated and microscope inspection techniques to redeposit particles on the first surface and do not effectively remove extremely small dust and debris.

EXAMPLE 1

An experimental set up was constructed generally as depicted in FIG. 2. A backup roll 14 constructed from 10 inch (25.4 centimeters) outer diameter aluminum metal cylinder was provided. A web of 0.002 inch (0.00508 centimeter) thick and 9 inches (22.86 centimeters) wide of optical grade polyester film, commercially available from 3M, St. Paul, Minn. was wrapped around the backup roll approximately 90 degrees as it was conveyed through the apparatus. The approximate length of the web was 200 ft.

While the web was conveyed around the backup roll at a line speed of 15 feet/minute (4.572 meters/minute), two CD spray manifolds 42, each having a single row of four spray nozzles 42, created a first and a second high pressure spray zone (50, 52). Each spray nozzle (Spraying Systems Company model number TPU150017) had a single orifice of 0.010 inch equivalent diameter and was provided with de-ionized water filtered to 0.2 micron absolute and pure to a resistive level of 18 MOhm while supplied at a pressure of 1500 psi. The flexible web was dried by the exit gas curtain 26 using an Exair model #2012SS air bar oriented at a 13 degree angle to direct and focus the main flow of compressed air in a line across the flexible web so as to remove substantially all water from the web. The first and second inspection systems (54, 56) inspected the first surface to measure dirt particles before and after web cleaning.

COMPARATIVE EXAMPLE 2

For Comparative Example 2, a tacky roll cleaning system, 6RNWC-IIA, manufactured by Polymag Tek Inc., Rochester, N.Y. was used. The 6 roll narrow web cleaner system is designed to remove loose particulate contamination from a moving substrate. The POLYMAG® blue contact cleaning rolls contact both sides of the web as it transports through the web cleaner. Surface contamination is transferred from the web to the contact cleaning rolls. The 1.25" O.D. contact cleaning rolls are then continuously cleaned with two adhesive tape rolls. The top contact cleaning rolls and adhesive tape roll assemblies create a nip between the web and the lower fixed contact cleaning rolls. The web drives the four contact cleaning rolls and the two tape rollers. The contamination from the web is collected on the surface of the adhesive tape rolls. When the adhesive tape rolls become saturated, a layer of tape can be removed. Each adhesive tape roll contains approximately 66 feet of adhesive tape. Approximately one foot of tape is used per tape change.

A web of 0.002 inch (0.00508 centimeter) thick and 9 inches (22.86 centimeters) wide of optical grade polyester film, commercially available from 3M, St. Paul, Minn. was conveyed through the tacky roll cleaning system at a line speed of 15 fpm with the nip pressure set at 60 psi. The approximate length of the web was 200 ft. The first and second inspection web systems inspected the first surface to measure dirt particles before and after the tacky roll cleaning system.

COMPARATIVE EXAMPLE 3

For Comparative Example 3, a dual ultrasonic web cleaner manufactured by Web Systems, Inc., Broomfield, Colo. was used. The web cleaner has two ultrasonic nozzles located on opposite sides of a cross-direction vacuum tube that is curved for close placement to an idler roller. The web to be cleaned is conveyed around the idler roller underneath the ultrasonic web cleaner.

A web of 0.002 inch (0.00508 centimeter) thick and 9 inches (22.86 centimeters) wide of optical grade polyester film, commercially available from 3M, St. Paul, Minn. was conveyed through the ultrasonic web cleaning system at a line speed of 15 fpm. The approximate length of the web was 200 ft. The first and second inspection systems inspected the first surface to measure dirt particles before and after the ultrasonic web cleaning system.

TABLE 1

Web Cleaning Results

| | Counts Before Cleaning (counts/m 2) | Counts After Cleaning (counts/m 2) | % of Particles Removed |
|---|---|---|---|
| Example 1 | 455 | 4 | 99 |
| Comparative Example 1 | 282 | 162 | 42 |
| Comparative Example 2 | 385 | 318 | 17 |

Table 1 presents the results of the three experiments. As seen, the web cleaning method of the present invention removes significantly more dirt and debris having a size of 3 microns or greater from the surface of the web than the prior existing methods.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in a consistent manner. In the event of inconsistencies or contradictions between the incorporated references and this application, the information in the preceding description shall control. The preceding description in order to enable one of ordinary skill in the art to practice the claimed invention is not to be construed as limiting the scope of the invention, which is defined by the claims and all equivalents thereto.

What is claimed is:

1. A method of cleaning a web of material comprising:

supporting the web with a backup roller;

spraying a first surface of the web with a high pressure liquid while a second opposing surface of the web is in contact with the backup roller;

directing a gas curtain at the first surface, after spraying, while the opposing second surface is supported by the backup roller;

supplying a first cleaning solution to the center of a porous cleaning roller; and contacting the first surface with the cleaning roller, prior to spraying, while the second opposing surface is supported by the backup roller.

2. The method according to claim 1 further comprising compressing the cleaning roller against the first surface.

3. The method according to claim 2 further comprising rotating the cleaning roller in a direction opposite to the web's direction about the backup roll.

4. The method of claim 1 wherein the supplying further comprises a surfactant solution supplied to a drip bar located above the cleaning roller.

5. The method of claim 1 further comprising directing a gas curtain at the first surface prior to spraying.

6. The method of claim 1 further comprising enclosing at least a portion of the backup roll in a spray chamber while spraying the web.

7. The method of claim 6 further comprising exhausting gas from the spray chamber to maintain a pressure between about −0.001 to about −0.50 inches of water gage in the spray chamber.

8. The method of claim 1 further comprising heating, and filtering a gas supplied to the gas curtain prior to directing the gas at the first surface.

9. An apparatus for cleaning a web of material, comprising:

a backup roller positioned to wrap the web at least partially around the backup roll;

a source of high pressure liquid connected to at least one nozzle for spraying the web while the web is supported by the backup roll;

a source of compressed gas connected to an exit gas curtain located after the at least one nozzle in the direction of the web's travel around the backup roll and positioned for removing liquid from the web while the web is supported by the backup roll;

a cleaning roller located prior to the at least one nozzle and positioned to contact the web while the web is supported by the backup roll; and a first cleaning solution supplied to the center of the cleaning roller.

10. The apparatus according to claim 9 wherein the cleaning roller comprises a material selected from the group consisting of polyvinyl alcohol, polyvinyl acetyl, and polyvinyl formal and has a raised mesa patterned exterior surface.

11. The apparatus according to claim 10 further comprising a drive for rotating the cleaning roller in a direction opposite to the direction of the web's travel.

12. The apparatus of claim 9 further comprising a drip bar positioned to supply a surfactant solution to the cleaning roller or to the web.

13. The apparatus of claim 9 further comprising a source of compressed gas connected to an entry gas curtain directing the compressed gas towards the web while the web is supported by the backup roll.

14. The apparatus of claim 9 further comprising a spray chamber having a drain and an exhaust duct, and the spray chamber enclosing at least a portion of the backup roll, the at least one spray nozzle, and the exit gas curtain.

15. The apparatus of claim 9 further comprising locating the apparatus in a clean room having a particle controlled atmosphere.

16. The apparatus of claim 9 further comprising an air deflector located between the at least one nozzle and the exit gas curtain.

* * * * *